United States Patent [19]

Stoner

[11] Patent Number: 4,827,829

[45] Date of Patent: May 9, 1989

[54] RECOIL AND COUNTERRECOIL BUFFER FOR AUTOMATIC CANNON

[75] Inventor: Eugene M. Stoner, Palm City, Fla.

[73] Assignee: Ares, Inc., Port Clinton, Ohio

[21] Appl. No.: 127,521

[22] Filed: Nov. 27, 1987

Related U.S. Application Data

[60] Continuation of Ser. No. 52,217, May 18, 1987, abandoned, which is a continuation of Ser. No. 796,585, Nov. 8, 1985, abandoned, which is a division of Ser. No. 559,304, Dec. 8, 1983, Pat. No. 4,599,933.

[51] Int. Cl.[4] ..... F41F 9/14

[52] U.S. Cl. ..... 89/43.01; 188/314; 267/64.15

[58] Field of Search ..... 89/43.01, 43.02, 177, 89/178, 198; 188/314; 267/64.15, 118, 126, 137

[56] References Cited

U.S. PATENT DOCUMENTS

| | | | |
|---|---|---|---|
| 1,310,893 | 7/1919 | Schneider | 89/43.01 |
| 1,333,283 | 3/1920 | Schneider | 89/43.01 |
| 1,342,709 | 6/1920 | Dawson et al. | 89/43.01 |
| 2,790,357 | 4/1957 | Garrett | 89/43.01 |

OTHER PUBLICATIONS

Lt. Col. William H. Tschappat, Text-Book of Ordnance and Gunnery, 1917, pp. 328-331.

*Primary Examiner*—Stephen C. Bentley
*Attorney, Agent, or Firm*—Allan R. Fowler

[57] ABSTRACT

A breech/receiver assembly for automatic cannon incorporates a rotating chamber and a recoil and counterrecoil buffer integrated within the breech. The breech, including the buffer means, recoils with the barrel and because the mass of the buffer is added to the breech and barrel, recoil forces transferred to trunions mounting the breech/receiver assembly are significantly reduced. The configuration of the breech/receiver assembly, including the rotating chamber and integrated recoil/counterrecoil buffer, enables a shorter receiver, thereby enabling a vehicle-mounted cannon utilizing the breech/receiver assembly of the present invention to elevate to high angles while still maintaining a relatively low gun silhouette.

3 Claims, 5 Drawing Sheets

RECOIL AND COUNTERRECOIL BUFFER FOR AUTOMATIC CANNON

This invention was made with Government support under Contract No. DAAK10-78-C-0026 awarded by the United States Department of Defense. The Government has certain rights in this invention.

CROSS-REFERENCE TO OTHER APPLICATIONS

This application is a continuation of application Ser. No. 52,217, filed 5/18/87, now abandoned, which is a continuation of application Ser. No. 796,585, filed Nov. 8, 1985, now abandoned, which is a division of U.S. patent application Ser. No. 559,304, filed Dec. 8, 1983, now U.S. Pat. No. 4,599,933, issued July 15, 1986.

The present invention is directed to automatic cannon utilizing telescoped ammunition, wherein the shell projectile is entirely contained within the shell casing. More particularly, the present invention is directed to a breech/receiver assembly for such automatic cannon for enabling reduced recoil loading on gun mount trunnions thereby facilitating the mounting of the automatic cannon on assault vehicles, or the like.

BACKGROUND

Telescoped ammunition was developed in part to provide for greater shell storing densities and ease of ammunition feeding. These advantages stem from the fact that the telescoped shells are more uniform in diameter and shorter in length than conventional shells of comparable calibre. Although telescoped shells are generally larger in diameter than their counter-part conventional shells, their generally shorter length can facilitate shell handling and feeding.

Other advantages stemming from the shorter length of the telescoped ammunition include the cannon design and configuration. For example, the breech, or operating mechanism may be shorter. This is particularly true when a rotating type chamber is utilized. In turn, a shorter operating mechanism in a cannon may enable the cannon to elevate to high angles while at the same time providing a low profile for the cannon when mounted on an assault vehicle.

The present invention incorporates a rotating chamber within a breech/receiver assembly which is compact and lightweight to enable vehicle-mounted cannons utilizing the breech/receiver assembly of the present invention to elevate to high angles. Additionally, the breech/receiver assembly provides for reduced recoil loading on gun mount trunnions thereby facilitating the mounting of the cannon on the assault vehicles.

SUMMARY OF THE INVENTION

A breech/receiver assembly for automatic cannon in accordance with the present invention includes a receiver and a breech having means defining a first aperture therein for receiving a chamber and a second aperture therein communicating with the first aperture and adapted for receiving a barrel at an outside end thereof. The breech is adapted for slidable mounting within the receiver.

In addition, a chamber is provided with means for defining an opening therethrough sized for accepting ammunition. The chamber is mounted within the breech first aperture for rotational movement of from a first position in which the opening therein is aligned with the breech second aperture and a second position in which the opening therein is aligned for simultaneously accepting ammunition from a point outside of the breech and ejecting ammunition casings therefrom.

Combination recoil counterrecoil buffer means is disposed within the breech for buffering barrel recoil and counterrecoil forces as the breech block slides within the receiver. In this manner, the buffer means is integrated within breech and moves with it under recoil and counterrecoil. Because this increases the moving mass of the cannon, that is, the buffer means is added to the breech and barrel mass and moves with it, the recoil forces transferred to the trunnion mounts is significantly reduced.

Additionally, because of the integrated buffer, the breech/receiver assembly is shorter than conventional cannon which has the buffer disposed behind the breech. This reduction in the length of the breech-/receiver assembly in accordance with the present invention thereby permits high angle elevation of the cannon while still maintaining low mounting vehicle profile, or silhouette.

More particularly, the breech/receiver assembly in accordance with the present invention has a breech which includes four longitudinal chambers therein, with the first and second of such longitudinal chambers being disposed on opposite sides of the breech aperture and having axes generally parallel with one another, and the breech second aperture longitudinal axis. Third and of the longitudinal chambers within the breech are disposed on opposite sides of the breech first aperture and have axes generally parallel with the first and second longitudinal chambers. The combination recoil and counterrecoil buffer means disposed within the breech includes two fixed pistons, one piston being disposed in each of said first and second longitudinal chambers, and each having a piston rod attached to the receiver, and two movable pistons, one movable piston being disposed in each of the third and fourth longitudinal chambers.

In fact, the combination recoil and counterrecoil buffer means in accordance with the present invention includes two separate buffers, one being disposed on either side of the chamber disposed in the breech first aperture. The buffer means of the present invention are not aligned with the barrel axis, however, are symmetrically disposed thereabout, thereby eliminating any twisting moment or torque, between the buffer means and the barrel upon recoil and counterrecoil. As hereinbefore mentioned, because the buffers are not conventionally placed behind the breech and in line with the barrel axis, the overall length of the receiver is significantly reduced.

Continuing, the breech/receiver assembly in accordance with the present invention has the first and third longitudinal chambers in fluid communication with one another, and the second and fourth longitudinal chambers in fluid communication with one another. Further, hydraulic fluid is disposed in all of the longitudinal chambers with the hydraulic fluid being disposed between a forward face of the fixed pistons and a forward face of the movable pistons with the fluid communication between the longitudinal chambers enabling hydraulic fluid to flow from the first longitudinal chamber to the third longitudinal chamber and from the second longitudinal chamber to the fourth longitudinal chamber upon recoil of the breech. The fixed pistons moving within the breech first and second longitudinal chambers forces the hydraulic fluid from the first longitudinal chamber into the third longitudinal chamber and from the second longitudinal chamber into the fourth longitudinal chamber. The buffer means includes an inert gas compressed within the second and fourth longitudinal chambers, between a rear end thereof and a backface of the movable pistons disposed therein. The inert gas is under sufficient pressure to move the movable piston forward after recoil of the breech and force the hydraulic fluid from the second and fourth longitudinal chambers and into the first and third longitudinal chambers respectively, thereby returning the breech to a battery position.

For a cannon having a portion which recoils substantially in response to firing of the cannon and another portion which remains substantially stationary and non-recoiling in response to firing, a recoil and counterrecoil buffer is provided which, according to the present invention, comprises first, recoil, and second, counterrecoil fluid containing chambers formed in the cannon recoiling portion. Gas means are included for pressurizing fluid in the first and second chambers. Included are a first, recoil piston which has a piston head slidingly mounted in the first chamber and a piston shaft fixed to the cannon non-recoiling portion and a second, counterrecoil piston which has a piston head slidingly disposed in the second chamber and a piston shaft which extends from the second chamber when the cannon recoiling portion is in a full recoil position.

The first, recoil piston is responsive to recoil movement of the cannon recoiling portion for moving in the first chamber in a direction causing increased pressure in the gas means so as to slow and stop recoil movement of the recoiling portion and to then drive such portion back forwardly in counterrecoil. The second, counterrecoil piston is operative, in response to counterrecoil movement of the cannon recoiling portion, for engaging the cannon non-recoiling portion and for being thereby moved in the second chamber in a direction causing increased pressure in the gas means so as to slow counterrecoil movement of the recoiling portion before such portion reaches a battery position, the compressed gas in the gas means functioning as an energy absorbing and returning spring. Preferably the second chamber is disposed in the first chamber so that such chambers and the first and second pistons mounted therein are on a common longitudinal axis which is parallel to a barrel bore axis of the cannon.

Comprising the gas means are a third chamber and a third, floating piston which is slidingly disposed therein so as to divide such chamber into a gas containing portion and a fluid containing portion, the volume of the fluid and gas portions being dependent upon the position of the floating piston. The fluid containing portion of the third chamber is in fluid flow communication with the first and second chambers so that movement of the first and second pistons control movement of the third piston and so that the compressed gas acting on the third piston, opposes any movement of the first and second pistons which forces fluid from the first and second chambers into the fluid containing portion of the third chamber. As a result, the compressed gas in the third chamber not only buffers recoil and counterrecoil of the cannon recoiling portion but also maintains such portion in the battery position except when such portion recoils and counterrecoils after firing.

Means are preferably provided for indicating when the amount of fluid in the fluid containing portion of the third chamber is less than a pre-established amount assuring proper buffer operation. The indicating means include a fourth, fluid containing chamber disposed in the fluid containing portion of the third chamber and a fourth piston slidingly mounted in the fourth chamber. The fourth piston is configured so that it is normally fully retracted into the fourth chamber and so that when the amount of fluid in the fluid containing portion of the third chamber is greater than the pre-established amount, the floating piston is clear of the fourth piston. As fluid is lost from any of the chambers, the compressed gas in the third chamber pushes the floating piston towards the fourth piston. If sufficient fluid is lost, the compressed gas causes the floating piston to push the fourth piston partly out of the fourth chamber so as to provide a visual warning of fluid loss.

Preferably, the buffer comprises a pair of the above-described buffers arranged symmetrically about the barrel bore axis so that eccentric forces are not applied to the cannon recoiling portion. As such, two recoil chambers and pistons are provided, longitudinal axes thereof being parallel to, and equally spaced from, the barrel bore axis and in a plane therethrough. Two counterrecoil chambers and pistons are similarly arranged, as are two chambers and floating pistons comprising the gas means and two chambers and pistons comprising the fluid level indicating means.

The buffer is adapted for use with many types of cannon (or guns) and is not necessarily limited to use with the rotating chamber type of automatic cannon described herein.

BRIEF DESCRIPTION OF THE DRAWINGS

The advantages and features of the present invention will be better understood by the following description and drawings in which.

DETAILED DESCRIPTION

Figure 1:
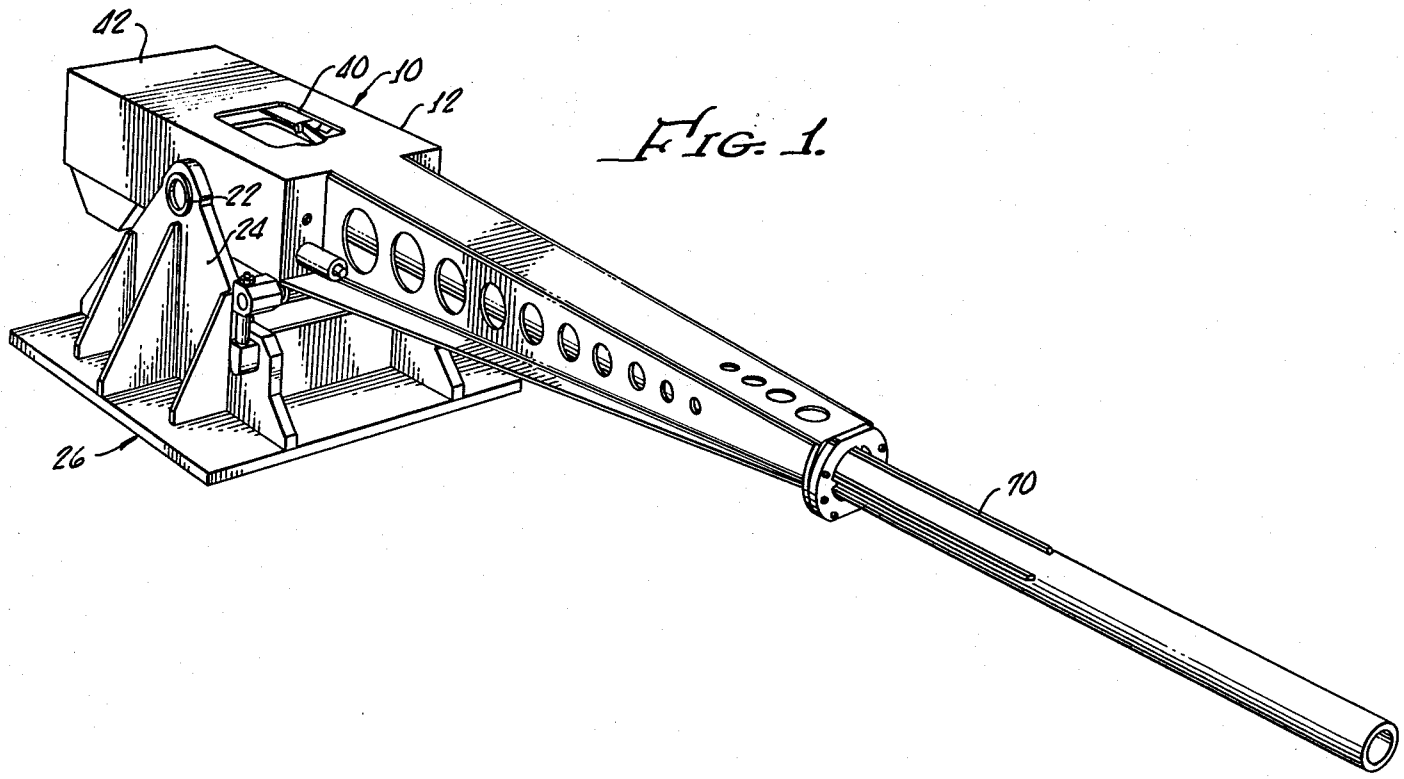
FIG. 1 is a perspective view of a breech/receiver assembly in accordance with the present invention, as used with an automatic cannon, and including a gun mount for securing the cannon to an assault vehicle or the like. Also shown are gun mount trunions coaxially aligned with the chamber of the breech/receiver assembly and generally showing a short breech/receiver assembly for enabling high elevation of the cannon while maintaining a low profile or silhouette.
Figure 2:
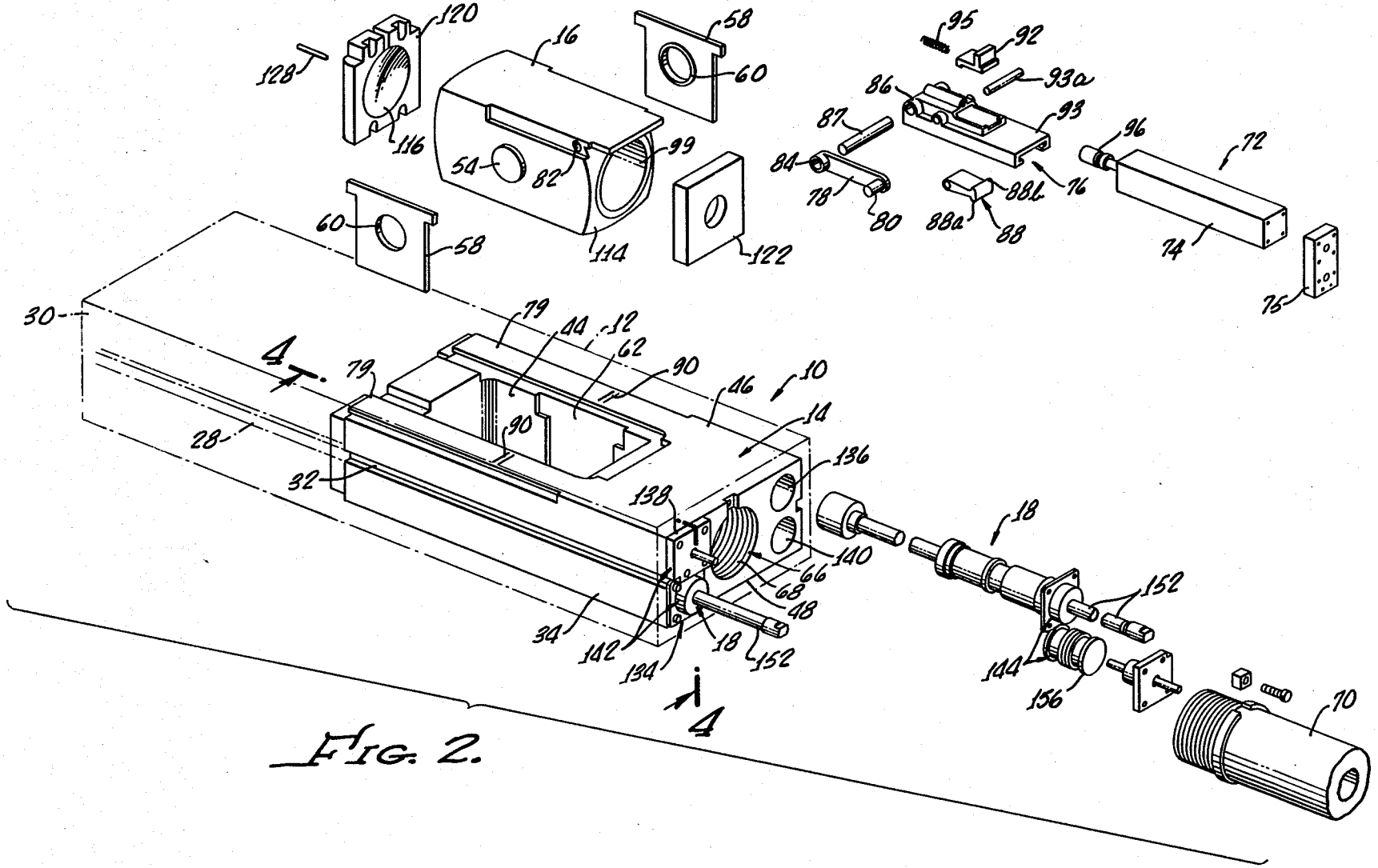
FIG. 2 is an exploded perspective view of the breech-/receiver assembly generally showing the receiver, in phantom lines, a breech mounted for a slidable motion within the receiver, a rotating chamber and an integrated recoil and counterrecoil buffer means.

Referring now to FIGS. 1 and 2, a breech/receiver assembly 10 in accordance with the present invention generally includes a receiver 12, a breech 14, a chamber 16 and combination recoil and counterrecoil buffer means 18 disposed within the breech 14.

The receiver 12 is generally rectangular in shape and has a pair of coaxial trunnions 22 for pivotally mounting the breech/receiver assembly 10 to upstanding portions 24 of a gun mount 26.

Shown in phantom lines in FIG. 2, tracks 28 are provided on inside surfaces 30 of the receiver 12 for slidably mounting the breech 14, which is adapted for such slidable mounting within the receiver by means of grooves 32 in the sides 34 thereof. An opening 40 in the top 42 of the receiver (FIG. 1) and another in the bottom of the receiver (not shown) enable access to the breech 14 and the chamber 16 therein when the breech is in a battery position for the loading of shells and ejection of casings as will be hereinafter discussed in greater detail.

As more clearly shown in FIG. 2 the breech 14 has a first aperture 44 therethrough from the top 46 to the bottom 48 of the breech. The aperture 44 is generally rectangular and is disposed rearwardly of the breech 14 center and has therewithin the chamber 16 pivotally mounted by a pair of sidewardly projecting trunnions 56 which, when the breech is in a battery position, are aligned with the axis of the receiver mounting trunnions 22. This feature enables elevation of the gun without axially displacing the chamber from shell feeding apparatus (not shown) disposed beneath the receiver and within an assault vehicle (not shown) on which the breech/receiver assembly 10 is mounted.

A pair of trunnion plates 58 having holes 60 therein for receiving the chamber trunnions 54 support the chamber 16 within the breech first aperture 44 and fit downwardly into recesses 62 on opposite sides of the breech first aperture 44.

A second aperture 66 communicating with the first aperture 44 is formed in the breech 14 and adapted, by means of threads 68, for receiving a barrel 70.

Chamber rotating means, or apparatus, 72 are provided for rotating the chamber, which generally includes a hydraulic cylinder 74, mounted to the receiver 12 by means of a bracket 75, a slide 76 and an arm 78.

The cylinder 74 is mounted within the receiver and over the breech in position for engagement with the slide 76. Slide 76, is mounted on a track 79 formed on the breech top. It should be appreciated that two tracks 79 are shown and the chamber opening apparatus 72 may be mounted on either side of the chamber, or on both sides. The arm 78 interconnects the slide 76 with the chamber 16 by means of a pin 80 engaging a hole 82 in the chamber 16 and an opposite end 84 of the arm engages a bracket 86 on the slide 76 by means of a pin 87.

A latch 88 is disposed beneath the slide 76 for engagement with a notch 90 formed in the track 79 and a lock 92 is spring mounted to a top 93 of the slide 76 by means of a pin 94 and spring 95.

In operation, the chamber is locked in the battery position by means of the latch 88 engaging the notch 90 by means of a lower lip 88*a*. Upon actuation of the hydraulic cylinder 74, a piston end 96 thereof, engages the lock 92 pushing it against the spring 95, enabling the latch 88 to be released from the notch 90. At this point, the slide 76 is free to slide rearwardly along the track 79 and rotate the chamber 16 open by means of the arm 78.

When the latch 88 is raised from the notch 90, an upper lip 88*b* thereof engages the piston end 96, thereby fixing the piston end to the slide 76 when the latch is not engaging the notch 90 and linking the piston end 96 to the chamber 16. This enables the hydraulic cylinder 74 to pull the slide 76 forwardly to close the chamber 16.

Closing of the chamber 16 is caused by retracting the hydraulic cylinder 74 enabling the slide to move forward along the track 79 thereby causing the closing of the chamber 16 and locking of the chamber to the breech 14 as the latch 88 re-engages the notch 90. The piston end 96 is not attached to the slide, at this time, hence, the breech is free to slide within the receiver 12 upon recoil of the gun without further movement of the cylinder 74.

Figure 3B:
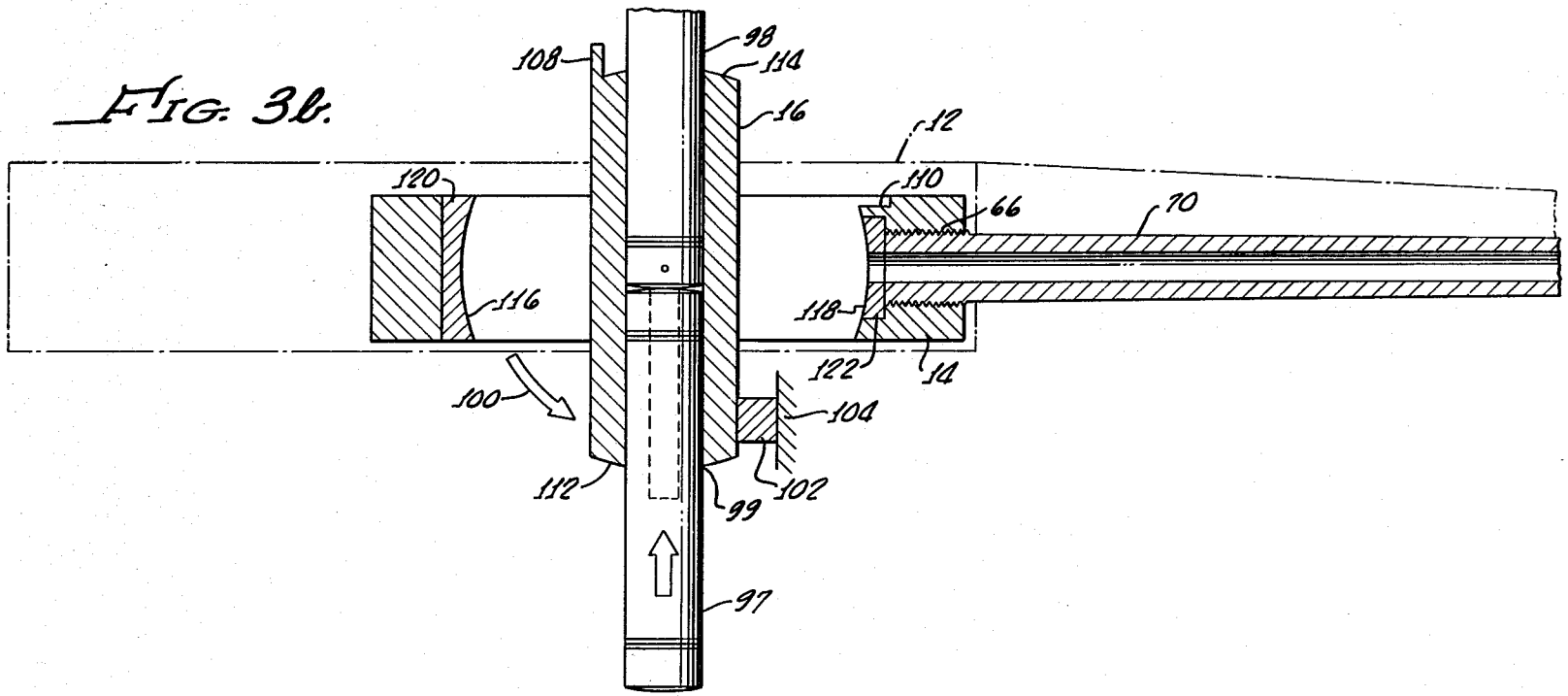
FIGS. 3*a* and 3*b* are cross-sectional side views of the breech/receiver assembly showing rotation of the chamber within the breech when the breech is at a battery position for enabling reloading of the chamber and ejection of casings; and, FIGS. 4*a*, 4*b*, 4*c* and 4*d* are cross-sectional views of one of the recoil/counterrecoil buffers showing longitudinal chambers within the breech assembly and a fixed and movable piston therein, each of the figures showing a different position of the fixed and movable pistons within the longitudinal chambers as the cannon undergoes recoil and counterrecoil.
Figure 3A:
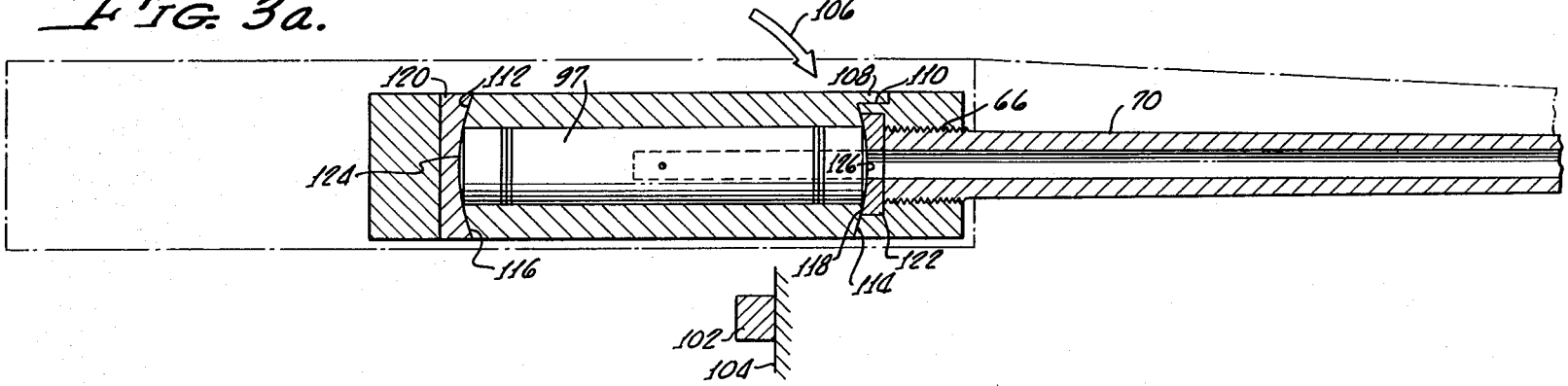

The chamber 16 has an opening 99 of appropriate size, or calibre, for accepting a shell 97 and the chamber 16 is mounted within the breech block 14 by means of the trunions 54 for rotational movement from a first position (FIG. 3*a*) in which the opening 99 is aligned with the breech second aperture 66 and the barrel 70 and a second position (FIG. 3*b*) in which the opening 99 therein is aligned for simultaneously accepting a shell 97 from a point outside the breech block 14 and ejecting fired shell casings 98 therefrom.

In this operation, the chamber 16 is rotated in the direction of Arrow 100 until it hits a stop 102 fixed to a non-moving portion 104 of the gun or surrounding structure, the stop 102 being positioned so that the chamber opening 99 is aligned with the shell 97 which has been moved (by a mechanism not shown) into a shell feeding position.

After the shell 97 has been loaded upwardly into the chamber opening 99, thereby also causing ejection of the shell casing 98 from the chamber opening 99, the chamber 16 is rotating in a closing direction, indicated by Arrow 106 until a projecting chamber lip portion 108 strikes a breech recess portion 110. Since the chamber 16 is rotated from a fixed closed position to an open position determined by the stop 102, proper chamber opening and closing is assured regardless of gun elevation angle.

As an example, if the barrel 70 is pointing horizontally, that is, zero degrees of elevation, the total rotation of chamber 16 is 90 degrees. However, if the barrel elevation angle is 45 degrees, the rotational movement of the chamber 16 from an open to a closed position is only 45 degrees. Further, since the chamber 16 and the breech/receiver assembly 10 rotate about the same axis when the breech is in a battery position for accepting ammunition into the chamber and thereafter firing it, elevation of the barrel 70 by rotation of the receiver 12 about the trunnions 22 does not axially displace the rotating chamber 16 from the stop 102.

That is, despite rotation of the receiver 12, the stop 102 strikes the chamber 16 at the same point, the only change in the rotational movement of the chamber being the amount of rotation from an open to a closed position. This feature enables ammunition feeding apparatus (not shown) to be fixed to the support structure, or assault vehicle, and in an operational relationship with the breech/receiver assembly 10 for feeding ammunition thereinto without any flexible coupling mechanism for accommodating relative movement between the breech/receiver assembly and the feed mechanism due to barrel 70 elevation.

The chamber 16 has spherical surfaces 112, 114 on opposite ends thereof which closely mate with correspondingly curved surfaces 116, 118 of breech block insert plates 120, 122 when the chamber 16 is in a closed position with the opening 99 therein aligned with the breech block second aperture 66 and barrel 70 for firing the shell 97.

Upon such firing, longitudinal expansion of the shell 99 forces shell end surfaces 124, 126 to conform to the surfaces 116, 118, respectively, thereby creating a seal therebetween, firing of the shell being accomplished by an electrically operated firing pin or ignitor 128 through the plate 120 (FIG. 2).

The combination recoil and counterrecoil means 18 is integrated into the breech on opposite sides of the aperture 44 which receives the chamber 16, by means of first, second, third, and fourth longitudinal chambers 134, 136, 138, 140, the first and second longitudinal chambers 134, 136 being disposed on opposite sides of the breech first aperture 46 having axes generally parallel with one another and with the breech block second aperture 66. The third and fourth longitudinal chambers 138 and 140 are also disposed on opposite sides of the breech 14 and adjacent the first and second longitudinal chambers respectively with their axes generally parallel with the first and second longitudinal chamber axes.

Upon examination it can be seen that the combination recoil and counterrecoil buffer means 18 includes two separate recoil and counterrecoil buffer systems 142, 144 disposed on either side of chamber 16. This symmetrical placement of the two buffer systems about the chamber and barrel eliminates any net twisting moment or torque between the buffer systems 142, 144 and the barrel upon recoil and counterrecoil.

It should be appreciated that hereinafter the discussion of the recoil and counterrecoil buffer means 18 shall be directed to only one of the buffer systems 142 which is shown disposed in the first and third longitudinal cylinders for clarity of presentation.

Generally, the recoil and counterrecoil means 18, shown in an exploded view in FIG. 2, and in various operational positions in FIGS. 4*a*, 4*b*, 4*c* and 4*d*, includes a fixed piston 148 having a piston head 150 disposed in the first longitudinal chamber 134 and a piston rod 152 which is attached to the receiver 12, or a member attached thereto (not shown), and a floating or movable, piston 156 disposed in the third longitudinal chamber 138.

Hydraulic or other incompressible fluid is disposed in the first and third longitudinal chambers 134, 138 between a forward face 160 of the piston head 150 and a forward face 162 of the movable piston 156, the first and third longitudinal chambers being in fluid communication with one another through an aperture 166.

An inert gas, such as nitrogen, or air, is compressed within the third longitudinal chamber between a rear end 170 thereof and a back face 172 of the movable piston 156 under sufficient pressure to move the movable piston 156 forward after recoil of the breech and force hydraulic fluid from the third longitudinal chamber 138 and into the first longitudinal chamber 134 to return the breech 14 to a battery position as will be hereinafter described in greater detail.

The remaining members of the recoil and counterrecoil means will be more particularly pointed out in conjunction with a description of the operation of the recoil and counterrecoil buffer means 18 as shown in the FIGS. 4*a* through 4*d*.

Figure 4A:
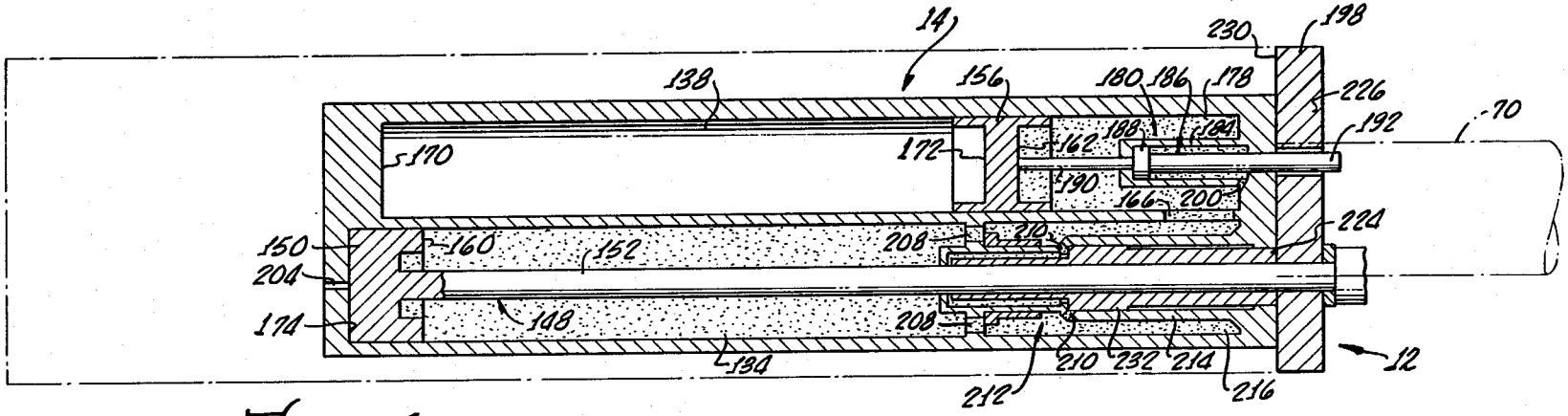

FIG. 4*a* shows the breech in a battery position with the piston head 150 at a rearward end 174 of the first longitudinal chamber 134. Gas pressure in the third longitudinal chamber 138 behind the movable piston 156 maintains the position of the movable piston against the hydraulic fluid in a forward portion 178 of the third longitudinal chamber 138, and against hydraulic fluid level indicating apparatus 180, which generally includes a chamber 184 disposed within the third longitudinal chamber 138 and in fluid communication therewith, and a piston 186 having an enlarged portion 188 disposed midway along the piston between rear and front piston ends, 190, 192. The rear piston end 190 extends from the chamber 184 into the third longitudinal chamber 138 and the front piston end 192 extends through a receiver wall 198 to the exterior of the receiver 12.

The movable piston 156 is held against the rear piston end 190 by the compressed inert gas therebehind and the piston 186 is held in a rearward position within the chamber 184 by the hydraulic fluid which communicates with the chamber 184 by a port 200. As the inert gas maintains the movable piston 156 against the hydraulic fluid in the third longitudinal chamber 138 and the rear of the piston 186, the level of the hydraulic fluid in front of the piston 156 is indicated by the amount of the front piston end 192 projecting past the receiver end 198, any leakage of hydraulic fluid from the buffer means indicated by an increased projection of the front piston end 192 when the breech is in the battery position.

Figure 4B:
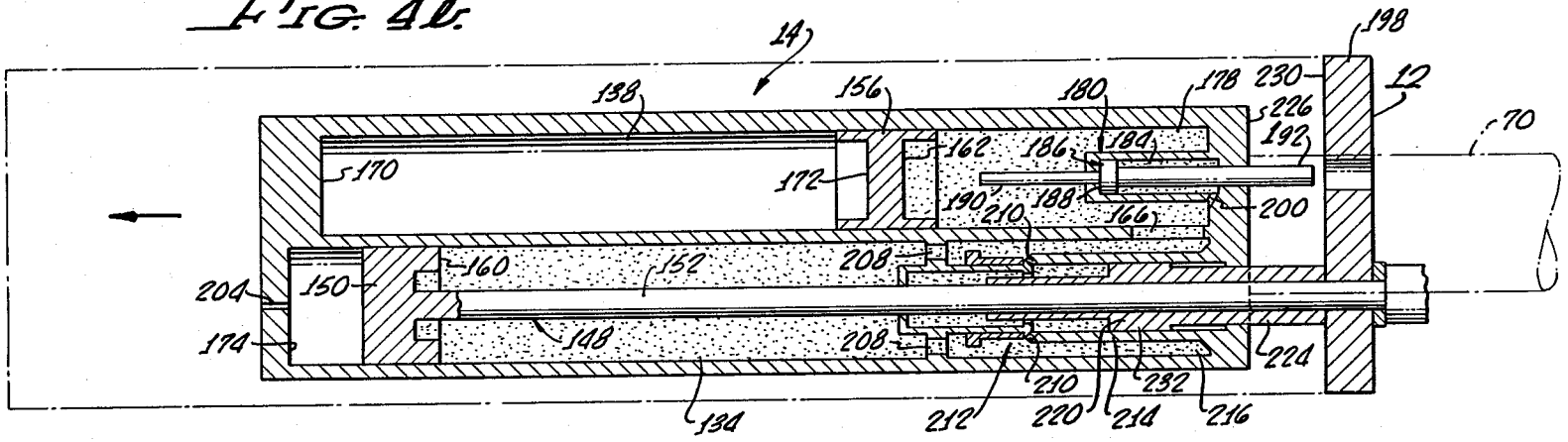
Figure 4C:
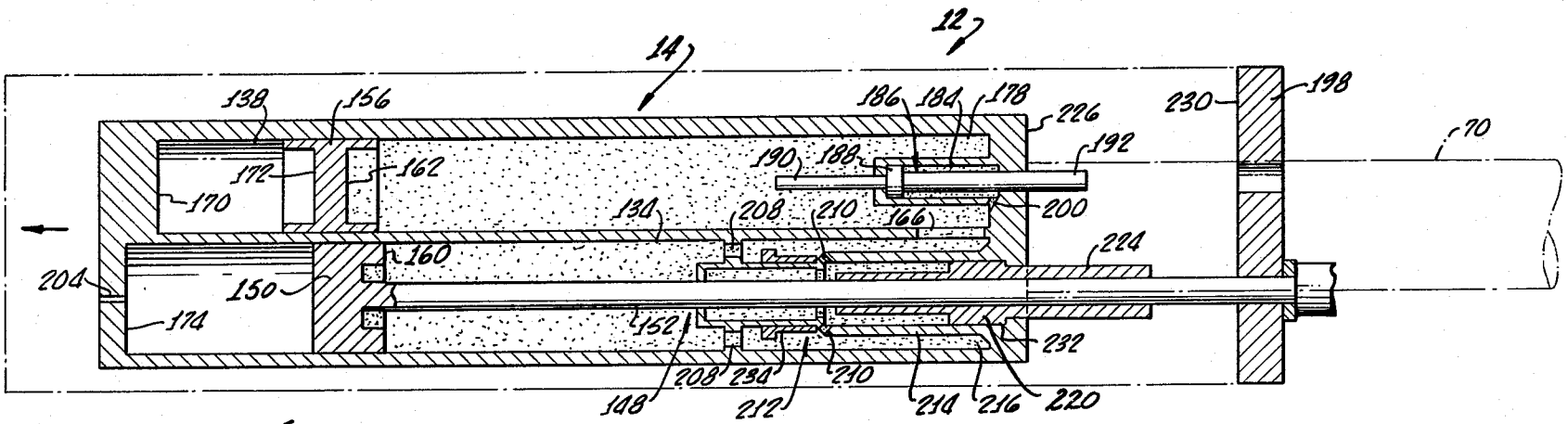

Turning to FIG. 4*b*, after firing of a shell, the breech 14 and the barrel 70 connected thereto begin to recoil and move in a rearward direction. During this motion the piston head 150 forces hydraulic fluid from the first longitudinal chamber 134 through the aperture 166 and into the third longitudinal chamber while drawing air into the first longitudinal chamber in back of the piston head 150 through an air port 204. The entry of hydraulic fluid forced by the piston head 150 into the third longitudinal chamber 138 causes the movable piston 156 to move rearwardly thereby further compressing the gas rearward of the movable piston 156, compression of the inert gas absorbing recoil energy and stopping the recoil of the breech 15 and barrel 70 before the movable piston 156 reaches the end 170 of the third longitudinal chamber 138 as shown in FIG. 4*c*.

Figure 4D:
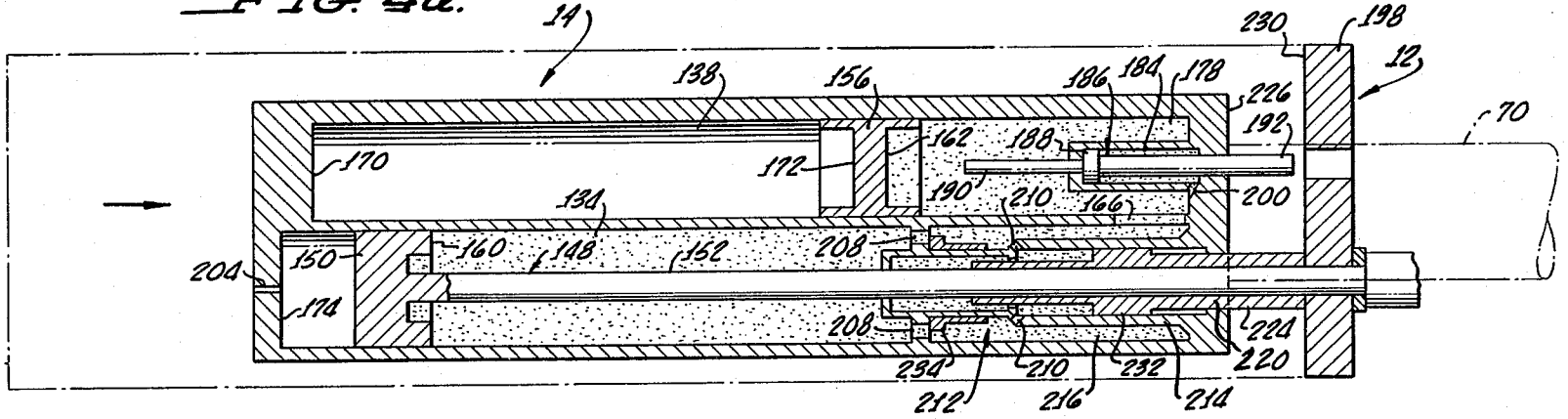

After the breech and barrel recoil is stopped, the compressed gas between the rear end 170 of the third longitudinal chamber and the movable piston 156 drives the piston 156 forwardly which in turn forces the hydraulic fluid from the third longitudinal chamber 138 back through the aperture 166 and into the first longitudinal chamber 134 thereby pushing the breech 14 back forwardly in counterrecoil as shown in FIG. 4*d*.

During recoil, the hydraulic fluid in the first longitudinal chamber 134 is forced through apertures 208, 210 and into the counterrecoil means 212, which generally includes a cylinder 214 mounted within the first longitudinal chamber 134 at a forward end 216 thereof and a tubular piston rod 220 disposed around the piston rod 152 and within the cylinder 214.

Movement of the hydraulic fluid into the rearward regions of the cylinder 214 forces the tubular piston 220 forwardly and causes a front end 224 to project in front of a breech forward face 226.

Turning again to FIG. 4d, as the breech 14 moves forwardly during counterrecoil and approaches the battery position, the tubular piston 220 comes in contact with a rear face 230 of the receiver wall and is moved rearwardly. An enlarged ring portion 232 of the tubular piston then forces hydraulic fluid from the cylinder 214 to the rear of the ring portion 232 through the orifice 210 and thereafter through the aperture 208 and back into the first longitudinal chamber.

A sleeve 234 is moved rearwardly as the hydraulic fluid is forced out of the chamber 214 and partially blocks the orifice 208. This restricted hyraulic fluid flow through the orifice 210 rapidly slows the breech and stops breech counter recoil.

Although there has been described thereinabove a specific arrangement of a breech/receiver assembly in accordance with the invention for purposes of illustrating the manner in which the invention may be used to advantage, it will be appreciated that the invention is not limited thereto. Accordingly, any and all modifications, variations, or equivalent arrangements which may occur to those skilled in the art should be considered within the scope of the invention as defined in the appended claims.

What is claimed is:

1. A recoil and counterrecoil buffer for a cannon having a portion which recoils substantially in response to firing of the cannon and another portion which remains substantially stationary and non-recoiling in response to said firing, the buffer comprising:

(a) means in the cannon recoiling portion defining fluid containing first, recoil and second, counterrecoil chambers;

(b) compressed gas means connected for pressurizing the fluid contained in the first and second chambers;

(c) a first, recoil piston, a head of which is sllidingly disposed in the first chamber and a shaft of which is connected to the cannon non-recoiling portion, said first piston being responsive to recoil movement of the cannon recoiling portion for moving in the first chamber in a direction causing increased pressure in the gas means so as to slow and stop said recoil movement and to then drive the cannon recoiling portion forwardly in counterrecoil;

(d) a second, counterrecoil piston, having a head which is slidingly disposed in the second chamber and a free shaft which extends to protrude from the second chamber when the cannon recoiling portion is in a full recoil position, said second piston being operative in response to counterrecoil movement of the cannon recoiling portion to proximate to battery position for engaging the cannon non-recoiling portion with its protruding free shaft and being thereby moved in the second chamber in a direction opposing the pressure in the gas means so as to slow counterrecoil movement before the cannon recoiling portion reaches its full battery position; and, (e) the second chamber being disposed within the first chamber, said first and second chambers being in fluid communication with one another.

2. A recoil and counterrecoil buffer for a cannon having a portion which recoils substantially in response to firing of the cannon and another portion which remains substantially stationary and non-recoiling in response to said firing, the buffer comprising:

(a) means in the cannon recoiling portion defining fluid containing first, recoil and second, counterrecoil chambers;

(b) compressed gas means connected for pressurizing the fluid contained in the first and second chambers;

(c) a first, recoil piston, a head of which is sllidingly disposed in the first chamber and a shaft of which is connected to the cannon non-recoiling portion, said first piston being responsive to recoil movement of the cannon recoiling portion for moving in the first chamber in a direction causing increased pressure in the gas means so as to slow and stop said recoil movement and to then drive the cannon recoiling portion forwardly in counterrecoil;

(d) a second, counterrecoil piston, having a head which is slidingly disposed in the second chamber and a free shaft which extends to protrude from the second chamber when the cannon recoiling portion is in a full recoil position, said second piston being operative in response to counterrecoil movement of the cannon recoiling portion to proximate to battery position for engaging the cannon non-recoiling portion with its protruding free shaft and being thereby moved in the second chamber in a direction opposing the pressure in the gas means so as to slow counterrecoil movement before the cannon recoiling portion reaches its full battery position;

(e) the compressed gas means comprising means defining a third chamber in the cannon recoiling portion and a floating, third piston slidingly disposed in the third chamber, said third piston dividing the third chamber into a compressed gas containing portion and a fluid containing portion, said fluid containing portion being in fluid flow communication with the first and second chambers so that movement of the first and second pistons controls movement of the third piston and so that the compressed gas acting on the third piston opposes any movement of the first and second pistons which forces fluid from the first and second chamber into the fluid containing portion of the third chamber; and, (f) means responsive to movement of the third piston for enabling a visaul determination of when the amount of fluid in the fluid containing portion of the third chamber is less than a pre-established amount assuring proper buffer operation, said means comprising means defining a fourth fluid chamber defined in the fluid containing portion of the third chamber and in fluid communication therewith, and a fourth piston disposed in said fourth chamber, said fourth piston being configured and positioned so that when the amount of fluid in the fluid containing portion of the third chamber is reduced to less than said pre-established amount, travel of the third piston, caused by the compressed gas in the gas containing portion of the third chamber, pushes against the fourth piston in a direction causing portions thereof to extend outside of the cannon recoiling portion, the amount of the extension of the fourth piston outside the cannon recoiling portion being indicative of the amount of fluid in the fluid containing portion of the third chamber, the greater the extension, the lesser the amount of the contained fluid.

3. A recoil and counterrecoil buffer for a cannon having a breech portion which recoils substantially in response to firing of the cannon and a receiver portion which remains substantially stationary and non-recoiling in response to firing of the cannon, the breecy portion being slidingly disposed in the receiver portion, the buffer comprising:

(a) means in the breech portion defining fluid containing first and second recoil chambers and first and second counterrecoil chambers, said first recoil and counterrecoil chambers being positioned to one side of a barrel bore axis of the cannon and said second recoil and counterrecoil chambers being positioned to the opposite side of the barrel bore axis, longitudinal axes of the first and second recoil chambers being parallel to and equidistant from the barrel bore axis and in a plane passing therethrough, longitudinal axes of the first and second counterrecoil chambers being parallel to and equidistant from the barrel bore axis and in a plane passing therethrough;

(b) compressed gas means connected for pressurizing the fluid contained in the first and second recoil and counterrecoil chambers;

(c) first and second recoil pistons, heads of which are slidingly disposed in respective ones of the first and second recoil chambers and shafts of which are connected to the cannon receiver portion, the recoil pistons being responsive to recoil movement of the cannon breech portion for moving in their respective recoil chambers in a direction causing increased pressure in the gas means so as to slow and stop recoil movement and to then drive the cannon breech portion forwardly in counterrecoil;

(d) first and second counterrecoil pistons, having heads which are slidingly disposed in respective ones of the first and second counterrecoil chambers and free shafts which extend to protrude therefrom when the cannon breech portion is in a full recoil position, the counterrecoil pistons being operative, in response to counterrecoil movement of the cannon breech portion, to proximate to battery position for engaging the cannon receiver portionwith their protruding free shafts and being thereby moved in their respective counterrecoil chambers in a direction opposing the pressure in the gas means so as to slow counterrecoil movement before the cannon breech portion reaches full battery position;

(e) the first counterrecoil chamber being disposed within the first recoil buffer so that their longitudinal axes are coincident, and the second counterrecoil chamber being disposed within the second recoil buffer so that their longitudinal axes are coincident; and, (f) the first recoil and first counterrecoil pistons being coaxial, and the second recoil and second counterrecoil pistons being coaxial.

* * * * *